US008334743B2

(12) United States Patent
Brendel

(10) Patent No.: US 8,334,743 B2
(45) Date of Patent: Dec. 18, 2012

(54) LEAD-OUT TUBE

(75) Inventor: Hartmut Brendel, Halle (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/350,276

(22) Filed: Jan. 13, 2012

(65) Prior Publication Data

US 2012/0169450 A1 Jul. 5, 2012

Related U.S. Application Data

(63) Continuation of application No. PCT/EP2010/004907, filed on Aug. 11, 2010.

(30) Foreign Application Priority Data

Aug. 19, 2009 (EP) ..... 09010635

(51) Int. Cl.
*H01F 27/36* (2006.01)

(52) U.S. Cl. ..... 336/84 C

(58) Field of Classification Search ..... 336/60, 336/84 R, 84 C, 205–206
See application file for complete search history.

(56) References Cited

U.S. PATENT DOCUMENTS

| | | | | |
|---|---|---|---|---|
| 3,939,449 | A * | 2/1976 | Boyd et al. | 336/60 |
| 4,156,221 | A * | 5/1979 | Graul | 336/59 |
| 6,680,665 | B2 * | 1/2004 | Aoki et al. | 336/174 |
| 7,692,524 | B2 * | 4/2010 | Miller et al. | 336/84 C |

FOREIGN PATENT DOCUMENTS

| | | | |
|---|---|---|---|
| CH | 659 907 | A5 | 2/1987 |
| CH | 695 968 | A5 | 10/2006 |

OTHER PUBLICATIONS

International Search Report (PCT/ISA/210) issued on Nov. 22, 2010, by European Patent Office as the International Searching Authority for International Application No. PCT/EP2010/004907.

* cited by examiner

*Primary Examiner* — Tuyen Nguyen
(74) *Attorney, Agent, or Firm* — Buchanan Ingersoll & Rooney PC

(57) ABSTRACT

A lead-out tube for high-voltage transformers is disclosed along with a method of manufacturing a lead-out tube. The lead-out tube can include a shielding tube of an electrically conductive material which extends a hollow-cylindrically around an at least sectionally curved path in an axial direction. A hollow-cylindrical shaped electrical insulating layer can be arranged at a first radial distance around the shielding tube along the axial extent. Sectionally flexible strips can be arranged along the at least sectionally curved path adjacent to one another at a second radial distance around the shielding tube. The insulating layer can be wound from a tape-like insulating material around the sectionally flexible strips.

19 Claims, 4 Drawing Sheets

LEAD-OUT TUBE

RELATED APPLICATION(S)

This application claims priority as a continuation application under 35 U.S.C. §120 to PCT/2010/004907, which was filed as an International Application on Aug. 11, 2010 designating the U.S., and which claims priority to European Application 09010635.2 filed in Europe on Aug. 19, 2009. The entire contents of these applications are hereby incorporated by reference in their entireties.

FIELD

The disclosure relates to a lead-out tube for transformers, for example, high voltage transformers with a shielding tube including an electrically conductive material which extends hollow-cylindrically around an at least sectionally curved path in an axial direction thereof, with a hollow-cylindrical shaped electrical insulating layer, arranged at a first radial distance around the shielding tube along the axial extent thereof.

BACKGROUND INFORMATION

High-voltage transformers for power supply systems with a voltage level of greater than or equal to 110 kV can be arranged in an oil-filled transformer tank for insulation and for better dissipation of waste heat produced during operation. The external electrical terminals can be arranged in the form of corresponding leadouts on the transformer tank.

In order to electrically connect end windings of transformer windings of the high-voltage transformer which are located in a transformer tank to the leadouts, respective electrical connecting conductors are passed through the oil-filled transformer tank. This can result in the connecting conductor diameter being relatively small, for example, a few cm. It may also be desirable for the conductor to be passed close to adjoining component parts with a high electrical potential difference, for example core-press parts or a further winding, for reasons of space. There can be a risk of undesirable flashovers or at least partial discharges when a corresponding electric field intensity is exceeded in regions.

In this respect, it is known to surround the respective connecting conductor with a lead-out tube along the extent of the connecting conductor. The lead-out tube can limit the maximum electrical field strength. A lead-out tube has an inner shielding tube of a conductive material, with the connecting conductor arranged in an interior of the shielding tube. The shielding tube is at the same electrical potential as the conductor passing through it during operation of the transformer, with the result that there is no potential difference between the connecting conductor and the shielding tube and a flashover or a partial discharge may not occur within the shielding tube.

The shielding tube can either be insulated by a thick single-ply insulating layer or can be surrounded by a plurality of barriers including an insulating material which are arranged hollow-cylindrically around the shielding tube and are radially adjacent to one another. In each case a space for the passage of transformer oil is provided between the barriers. The variant with insulating barriers can have electrical advantages over a single-ply insulating layer.

The manufacture of barriers with sectionally curved shielding tubes can be work-intensive. Lead-out tubes can be considered as individually manufactured products because power transformers with an identical design are manufactured in low numbers. Owing to improved space utilization within the transformer tank, even a plurality of points of curvature can be provided.

A modular system of component parts for the barriers of lead-out tubes has been used, with no more than one point of curvature of 90°. It is also possible for especially manufactured half-shell parts to be manufactured for the barriers, whereby a plurality of curvatures can be realized but a considerable degree of production complexity is involved for corresponding forms for a manufacture of the half-shell parts. Owing to the abovementioned rare manufacture of transformers of identical design, however, even the production of an individual form can involve an undesirably high level of complexity. In addition, an electrical weak point in the barrier results at the points of overlap between mutually adjoining modules or half-shells.

SUMMARY

A lead-out tube for high-voltage transformers is disclosed, the lead-out tube comprising a shielding tube of an electrically conductive material which extends hollow-cylindrically around an at least sectionally curved path in an axial direction thereof, a hollow-cylindrical shaped electrical insulating layer arranged at a first radial distance around the shielding tube along the axial extent thereof, sectionally flexible strips, which are each arranged along the at least sectionally curved path adjacent to one another at a second radial distance around the shielding tube, wherein the insulating layer is wound from a tape-like insulating material around the sectionally flexible strips.

An oil-filled transformer is disclosed, comprising: a lead-out tube for high voltage transformers including: a shielding tube of an electrically conductive material extending hollow-cylindrically around an at least sectionally curved path in an axial direction thereof; a hollow-cylindrical shaped electrical insulating layer arranged at a first radial distance around the shielding tube along an axial extent thereof; and a plurality of sectionally flexible strips each arranged along the at least sectionally curved path adjacent to one another at a second radial distance around the shielding tube; wherein the insulating layer is wound from a tape-like insulating material around the plurality of sectionally flexible strips.

A method for producing a sectionally curved lead-out tube for high-voltage transformers is disclosed, the lead-out tube including a shielding tube of an electrically conductive material which extends hollow-cylindrically around an at least sectionally curved path in an axial direction thereof, a hollow-cylindrical shaped electrical insulating layer arranged at a first radial distance around the shielding tube along the axial direction thereof, sectionally flexible strips which are each arranged along the at least sectionally curved path adjacent to one another at a second radial distance around the shielding tube, wherein the insulating layer is wound from a tape-like insulating material around the sectionally flexible strips, the method comprising: arranging the sectionally flexible strips on a circular path around the electrical insulating layer of the shielding tube, in each case along the axial direction thereof at the second radial distance therefrom; bending the sectionally flexible strips corresponding to a curvature of the shielding tube; fixing the sectionally flexible strips; winding the tape-like insulating material around an arrangement of the sectionally flexible strips to form a first insulating layer to surround and be spaced apart from the shielding tube; placing a plurality of supporting rings over the hollow-cylindrical insulating layer; axially spacing-apart and fixing the supporting rings; arranging the plurality of sectionally flexible strips on a circular path around an outer radii of the supporting rings in each case along the axial direction of the sectionally curved shielding tube; bending the sectionally flexible strips corresponding to a bend of the shielding tube; fixing the sectionally flexible strips; and winding the tape-like insulating material around the sectionally flexible strip arrangement to form a second insulating layer to surround and be spaced apart from the first insulating layer.

BRIEF DESCRIPTION OF THE DRAWINGS

The disclosure, embodiments and further advantages will be described in more detail with reference to the exemplary embodiments illustrated in the drawings, in which.

DETAILED DESCRIPTION

Figure 1:
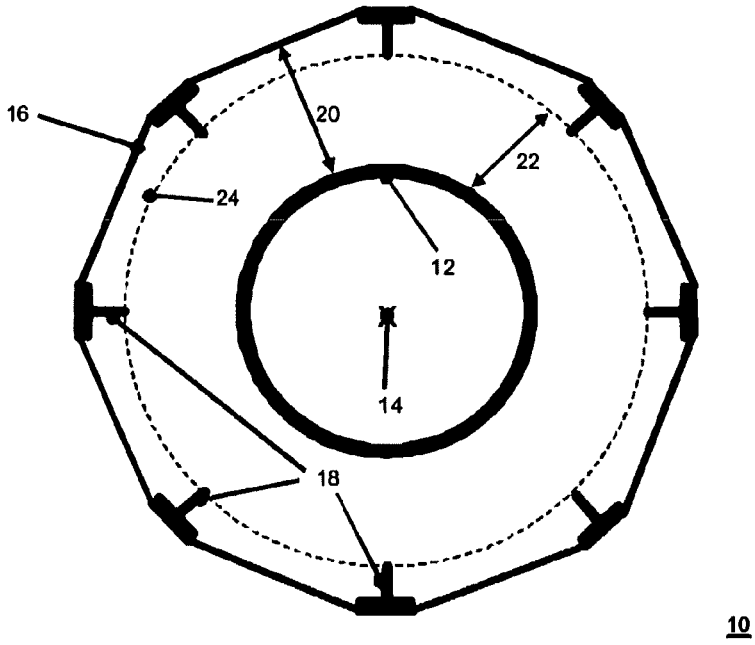
FIG. 1 shows an exemplary embodiment of a first lead-out tube according to the disclosure.

Exemplary embodiments of the disclosure provide a lead-out tube for high-voltage transformers which can be manufactured individually relatively easily and a corresponding production method.

A lead-out tube according to an exemplary embodiment of the disclosure includes a shielding tube of an electrically conductive material, an insulating layer arranged at a first radial distance around the shielding tube and wound from a tape-like insulating material around at least sectionally flexible strips, which are each arranged along the at least sectionally curved path, adjacent to one another, at a second radial distance around the shielding tube.

The barriers or insulating layers include a tape-like insulating material, for example, with the addition of an adhesive, wound directly around the shielding tube, which has a diameter of from about 60 mm to 150 mm, for example. This can enable simple individual manufacture of any desired forms of the barriers and can also avoid points of overlap between mutually adjoining component parts of an insulating layer. A winding operation of an insulating layer with a thickness of, for example, about 3 mm, and including a plurality of plies of an insulating tape can be relatively quick in the end result, even if it is performed manually, because any preparatory work, such as the production of a mold and subsequent production of a molding, are advantageously dispensed with. In addition even one winding operation around a tube form can also be automated correspondingly easily.

In order to realize a cavity through which oil can pass between the shielding tube and the insulating layer surrounding the shielding tube or a cavity between two adjacent insulating layers, the tape-like insulating material cannot be wound directly onto a radially inner surface. According to an exemplary embodiment of the disclosure winding of the tape-like insulating material around a plurality of strips which are arranged cylindrically and for example, parallel to one another, is provided. Such strips can be provided in each case along the cylinder circumference, for example at angular intervals of for example, about 15° to 45°. This can result in a polygonal cross section of the wound insulating layer instead of a circular one. It has been shown that the electrical functionality of a barrier with a polygonal cross section (≧8-sided polygon) is comparable with a circular cross section of a barrier. The strips themselves can also be formed from an electrically insulating material.

In a bending region of the shielding tube, the strips can follow the curvature of the shielding tube because, in accordance with the disclosure, they each can have the same radial distance from the shielding tube along their extent. Against this background, provision is made for the strips to be configured so as to be flexible, at least in the regions of curvature, for example, to enable flexibility in all directions. If a strip is arranged over a shielding tube, for example, which has a downward curvature, the strip needs to be able to bend in the vertical direction along its axial extent. In the case of a curvature towards the left or right, it needs to be able to bend in the horizontal direction.

In order to simplify the arrangement of strips in accordance with the disclosure, it is desirable for at least the same strip type to be used for one and the same strip layer. The strip type can have a correspondingly flexibility in the respective bending region.

It can also be desirable to provide flexibility of the strips only in the regions of curvature and to provide rigidity of the strips in the remaining, straight regions. The stability of the wound insulating layer in the axially straight regions can thus be increased.

In this way, the production of an insulating layer, or a barrier, which surrounds a shielding tube hollow-cylindrically and has a radially lower cavity for the passage of oil can be provided in a simple manner even for complex shielding tube geometries with a large number of regions of curvature.

In an exemplary embodiment of a lead-out tube according to the disclosure, a plurality of radially spaced-apart insulating layers are provided. A plurality of insulating barriers with a cavity located therebeneath for the passage of oil can be realized, as a result of which the distances from component parts with different electrical potentials can be reduced.

In an exemplary embodiment of a lead-out tube according to the disclosure, the at least sectionally flexible strips can be configured as an angled profile and can be provided, at least in the region of curvature, with a plurality of slots transversely with respect to a respective axial extent thereof. An angled profile with, for example, at least two flat strips which are arranged at an angle of about 90° with respect to one another and can be connected to one another, can have a high degree of stability in all possible bending directions with a low consumption of materials, which has proven to be useful for straight sections. By virtue of such flat strips being provided with slots in sections, it can be possible to achieve flexibility of the strip in a simple manner, with the result that a plurality of curvy strip sections can be formed which are connected to one another flexibly via an unslotted core region of the strip.

In accordance with an exemplary embodiment of a lead-out tube according to the disclosure, the angled profile of a flexible strip can, for example, be in the form of an X-shaped, T-shaped, V-shaped and/or Y-shaped profile. If a strip is arranged directly on a cylindrical outer surface, for example, directly on the shielding tube, an X-shaped profile, an inverted Y-shaped profile or an inverted V-shaped profile are desirable here. This can ensure good contact with a standing area formed in each case on two flat strips, for example even in the case of an adhesive joint.

In accordance with an exemplary embodiment according to the disclosure, the shielding tube can be enveloped in its radially outer region by a basic insulating layer with a thickness of about 1-5 mm, for example. The relevant insulating material, in contrast to the previously mentioned insulating layers, can be applied as a wet material, which has a correspondingly high mechanical strength and good contact with the shielding tube once it has cured.

In an exemplary embodiment of the disclosure, the radially innermost insulating layer can be spaced apart from the shielding tube or from the basic insulating layer thereof directly by the strips. In the case of a design of the lead-out tube with a plurality of barriers and a plurality of cavities arranged radially therebeneath for the passage of oil, the radial thickness of the cavities can be increased as the radial distance from the shielding tube increases. For example, a thickness of about 10 mm for the radially innermost cavity, about 25 mm for a second one and about 40 mm for a third one, if this is required, for example. A thickness of approximately 10 mm can be predetermined easily by a corresponding thickness of the respective strips, while thicknesses of 15 mm or more can require strips with an inappropriately high cross section, although this is of course also possible.

In an exemplary embodiment of the lead-out tube according to the disclosure, the strips, which are arranged at a radial distance around the shielding tube, of at least one insulating layer can be connected, along their axial extent, to a plurality of supporting rings, in each case on the radially outer circumference thereof. The supporting rings are each spaced apart axially from one another and arranged transversely with respect to the curved path and having an inner opening.

These supporting rings can enable an increased thickness of the respective cavity, for example, about 40 mm, given a relatively small strip cross section, for example about 15 mm. The use of the same type of strip can also be possible in the case of a plurality of radially spaced-apart insulating layers or barriers. These supporting rings can be pushed over the shielding tube or over an already arranged insulating layer and distributed equidistantly in the axial direction, for example, about every 15 cm to 40 cm, during production, with a reduced distance of adjacent supporting rings being desirable in a region of curvature. In this region, the respective strips can be flexible in accordance with the disclosure and can also have correspondingly better support.

In accordance with an exemplary embodiment of the disclosure, at least one supporting ring can surround a radially inner insulating layer with its inner opening with a mechanically operative connection. This is desirable for reasons of stability.

Such an operative connection can be realized in a simple manner if the inner opening of a supporting ring is polygonal, for example, with the same number of corners as the number of strips used to support the insulating layer located radially therebeneath. Specifically, if the outer cross section of the insulating layer and the inner cross section of the opening of the supporting ring are similar, but the diameter thereof differs by a few percentage points, for example, a supporting ring can be pushed particularly easily over the insulating layer. By virtue of a subsequent rotary movement of the supporting ring about the axial axis, the supporting ring can then be connected to the insulating layer particularly easily with a clamping connection. When using supporting rings in a plurality of insulating layers, it can be desirable for reasons of stability to arrange the supporting rings such that they are nested one inside the other.

In order to provide an axially continuous polygonal outer cross section of an insulating layer, the outer circumference of a supporting ring can also be polygonal.

In an exemplary embodiment according to the disclosure, the cross section of at least one supporting ring can have further cutouts, in addition to the inner opening. These cutouts are provided to enable the passage of oil through the cavity segments which adjoin one another axially and can be formed by the supporting rings.

The material of a supporting ring can be electrically insulating. It has proven to be suitable to use for example, pressboard. Pressboard is both easy to work, has a high mechanical stability and is suitable for being immersed in oil permanently. In a likewise advantageous manner, the flexible strips can also be produced from pressboard. It also is possible for other materials to be suitable.

In an exemplary embodiment of the disclosure, the tape-like insulating material includes a cellulose-based material, which can be wound easily.

A more complex use of a cured wet material such as in the case of the basic insulating layer is not required. In an exemplary embodiment in accordance with the disclosure, the tape-like insulating material can be coated on at least one side with an adhesive layer. The wound insulating tape can thus be prevented from sliding.

When using lead-out tubes according to exemplary embodiments of the disclosure in an oil-filled transformer, an expedited and simplified production process and also a smaller physical size owing to improved electrical properties can be achieved.

An exemplary embodiment of a method for producing a sectionally curved lead-out tube for high-voltage transformers includes arranging at least sectionally flexible strips on a circular path around an at least sectionally curved insulated shielding tube in each case along the axial extent thereof at a radial distance therefrom, bending, if necessary, the strips corresponding to the curvature of the shielding tube, fixing the strips, for example, by an adhesive joint, winding a tape-like insulating material around the strip arrangement to form a first insulating layer which surrounds the shielding tube and is spaced apart therefrom, placing a plurality of supporting rings over the hollow-cylindrical insulating layer formed in this way, axially spacing-apart and fixing the supporting rings, for example by an adhesive joint, arranging sectionally flexible strips on a circular path around the outer radii of the supporting rings in each case along the axial extent of the sectionally curved shielding tube, bending, if necessary, the strips corresponding to the bend of the shielding tube, fixing the strips, for example by an adhesive joint, winding a tape-like insulating material around the strip arrangement, to form a second insulating layer which surrounds the first insulating layer and is spaced apart therefrom.

FIG. 1 shows an exemplary embodiment of a lead-out tube 10 in a sectional illustration. A wound first insulating layer 16 with a polygonal cross section is arranged around a first shielding tube 12, which is manufactured from aluminum, for example, and can have an outer diameter, for example, of about 120 mm. Both the first shielding tube 12 and the first insulating layer 16 are arranged hollow-cylindrically around a curved path 14, which in this illustration can be seen as emerging from the illustrated plane.

A plurality of first flexible strips 18 with a T-shaped cross section are arranged along an imaginary circular path 24 around the path 14 at a radial distance 22 from the surface of the shielding tube 12. The transverse bar of the T profile is suitable for having a tape-like insulating material wound around it. This is because sharp edges can be avoided here which could cause the wound tape to be damaged. The specific way in which the strips 18 can be fastened and the arrangement of further components in the space between the shielding tube 12 and the circular path 24 are described below. In this cross-sectional illustration, the strips 18 can be arranged equidistantly in the form of a star around the path 14, with the result that an approximately circular polygonal cross section is produced which results in the wound insulating layer 16 borne by the strips. The insulating layer 16 can have a thickness of, for example, 1-5 mm, which results from the tape-like insulating material being wound around in multi-layered fashion and with an axial offset. The cross-sectional segments between the circular path 24 and the inner circumference of the insulating layer 16 represent respective cavities, through which oil flows when the lead-out tube is later installed in a transformer.

Figure 2:
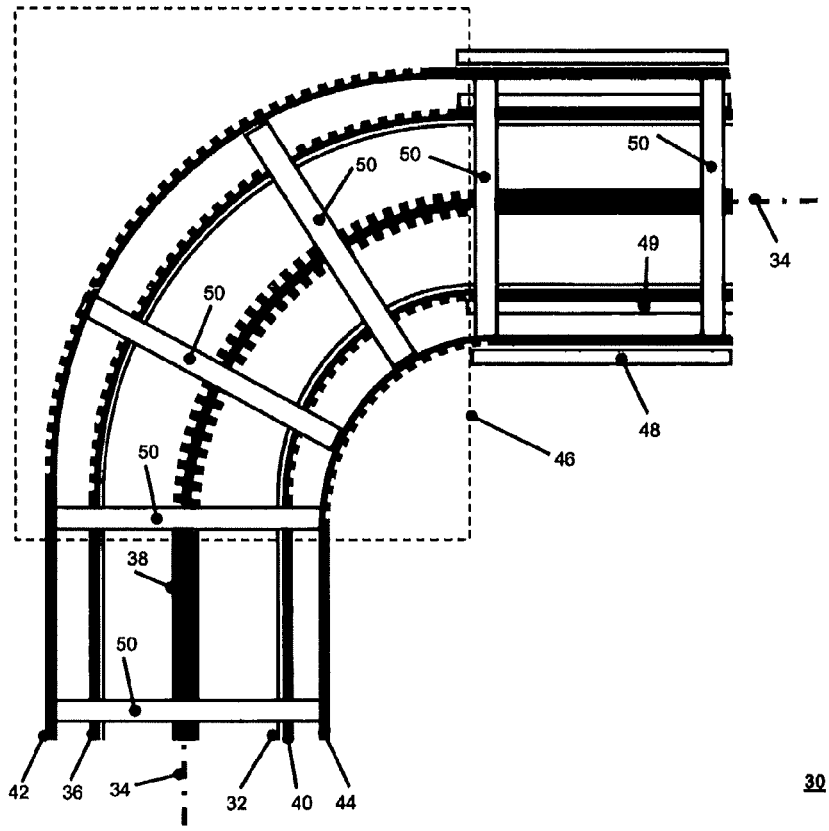
FIG. 2 shows an exemplary embodiment of a second lead-out tube.

FIG. 2 shows an exemplary embodiment of a lead-out tube 30 in a plan view, partially in sectional view. A second shielding tube 32, which follows a curvature of a path 34, is arranged hollow-cylindrically around a partially straight and partially (in the region 46) curved path 34, which substantially describes the profile of a connecting conductor which is surrounded by the second lead-out tube. This second shielding tube is conductive and, when installed in the transformer, is at the same electrical potential as the inner conductor. The electrical field strength is therefore reduced by the conductor at voltage potential.

A third flexible strip 38 is connected to the surface of the shielding tube 32 in an upper region of the shielding tube and along the curved path, for example, by an adhesive joint. The third strip 38 can be provided with slots within a curved region 46. The slots can ensure flexibility in this region. It is therefore possible for the third strip to follow the bend to the right in the shielding tube 32. A second strip 36 and a fourth strip 40 are indicated on both side faces of the shielding tube 32, which likewise have slots in the curved region and follow the respective bending direction.

Further, flexible strips can be arranged around the outer circumference of the shielding tube 32. All of these strips together can form an inner strip arrangement, on which an inner insulating layer 49 including a tape-like insulating material can be wound. For illustrative reasons, this insulating layer 49 is shown to extend over part of the axial length of the shielding tube 32 in FIG. 2. However, it can be wound along the entire axial length and completely around the circumference of the shielding tube 32.

A plurality of supporting rings 50, whose inner opening circumference enters into a mechanical operative connection with the outer circumference of the inner insulating layer 49, can be arranged at an axially predominantly equidistant distance around this inner insulating layer 49. Such an operative connection can be achieved by a supporting ring 50 being subjected to an axial rotary movement with respect to the surrounded inner insulating layer 49 if both have a polygonal cross section, matched to one another, with a gap in-between.

Similarly to the inner strip arrangement, further strips can now be arranged along the curved path 34 at a greater radial distance, the strips being indicated by the reference numerals 42 and 44. The strips can be supported by the supporting rings 50 and form an outer strip arrangement. Similarly to the inner insulating layer around the inner strip arrangement, a second insulating layer 48 can be wound around the outer strip arrangement, the second insulating layer likewise extending along the entire shielding tube 32.

Figure 3:
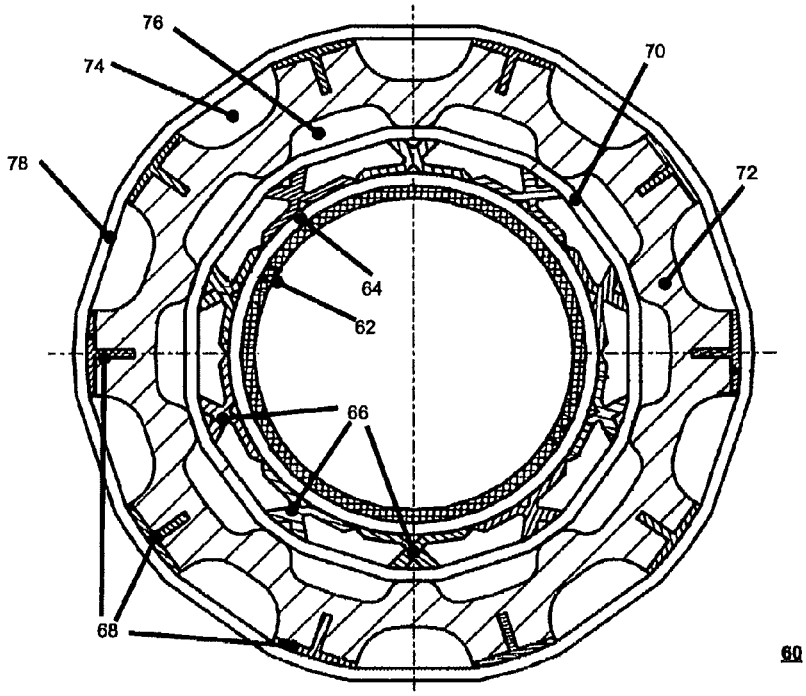
FIG. 3 shows an exemplary embodiment of a third lead-out tube according to the disclosure.

FIG. 3 shows an exemplary embodiment of a third lead-out tube in a simplified sectional illustration. In this example a basic insulating layer 64 including a wet material which has already been cured is applied around a third shielding tube 62. This basic insulating layer can prevent direct contact with the conductive shielding tube 62. A plurality of flexible strips 66 with a X-shaped cross section which space apart a third insulating layer 70 lying radially thereabove can be arranged equidistantly and parallel to one another along the circular circumference of the shielding tube. The X-shaped profiles are wider in their radially inner region and adjoin one another in order to be able to produce good mechanical contact with the basic insulating layer 64 of the shielding tube 62 and secondly to simplify the mechanical positioning of the strips 50. The X-shaped profile in the radially outer region adjacent to the third insulating layer 70 is desirable because a relatively large resting surface for the third insulating layer 70 can be provided. The interspace spaced apart in such a way is provided for the passage of transformer oil.

A second polygonal supporting ring 72 of, for example pressboard, surrounds, with its inner circumferential cross section, the polygonal third insulating layer 70. The inner circumference thereof is provided with a plurality of second cutouts 76, which can allow oil to flow through. Furthermore, these cutouts 76 can provide the supporting ring 72 with its polygonal inner structure as well. This is useful for clamping the supporting ring 72 onto the third insulating layer 70, with the clamped state being illustrated in this illustration. A rotation of the ring through approximately 18° towards the left or right can release this clamping connection, and the ring can then be moved over the third insulating layer 70.

Correspondingly, first cutouts 74, which can allow transformer oil to flow through the supporting ring axially, can also be provided along the outer circumference of the supporting ring 72. The circumferential regions which are not cut out are covered by a respective transverse bar of a respective T-shaped strip 68, which is clamped with its longitudinal bar into a corresponding slot in the outer circumference of the supporting ring 72. The first cutouts 74 ensure that the fourth insulating layer 78 which has been wound around the strips 68 is only supported by the strips and therefore has a polygonal cross section along its entire axial extent as well.

Figure 4:
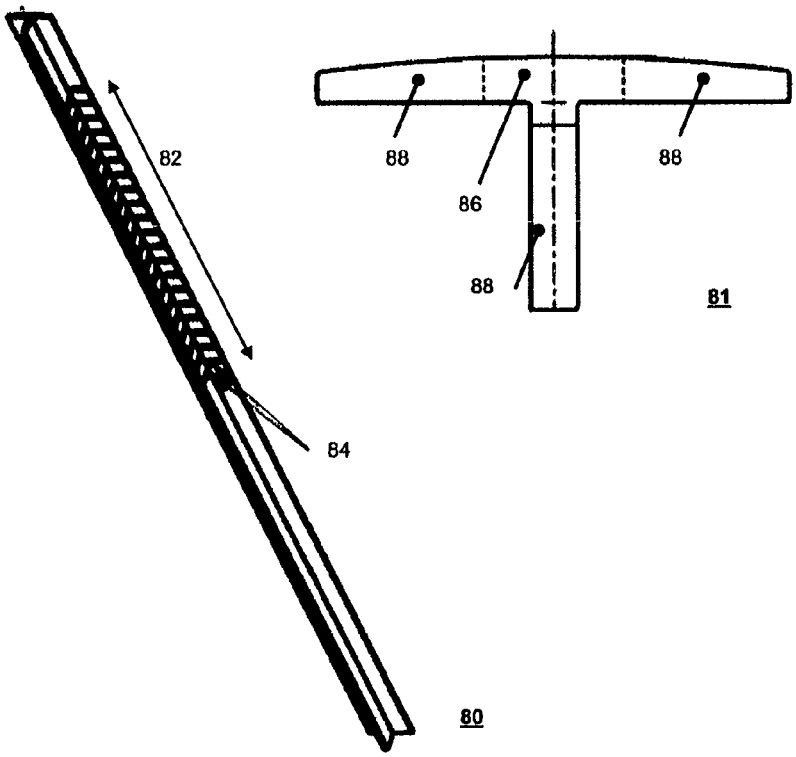
FIG. 4 shows an exemplary embodiment of a flexible strip according to the disclosure.

FIG. 4 shows an exemplary embodiment of a flexible strip with a T-shaped profile in a three-dimensional view 80 and in a cross-sectional view 81. The flexible slotted region is indicated along the arrow 82 and the slots are indicated by the reference numeral 84. The cross section of such a strip is about 20 mm×15 mm, for example, with a slot having a width of about 2 mm, for example. In the cross-sectional illustration 81, the slotted regions 88 and the core region 86 are illustrated.

Figure 5:
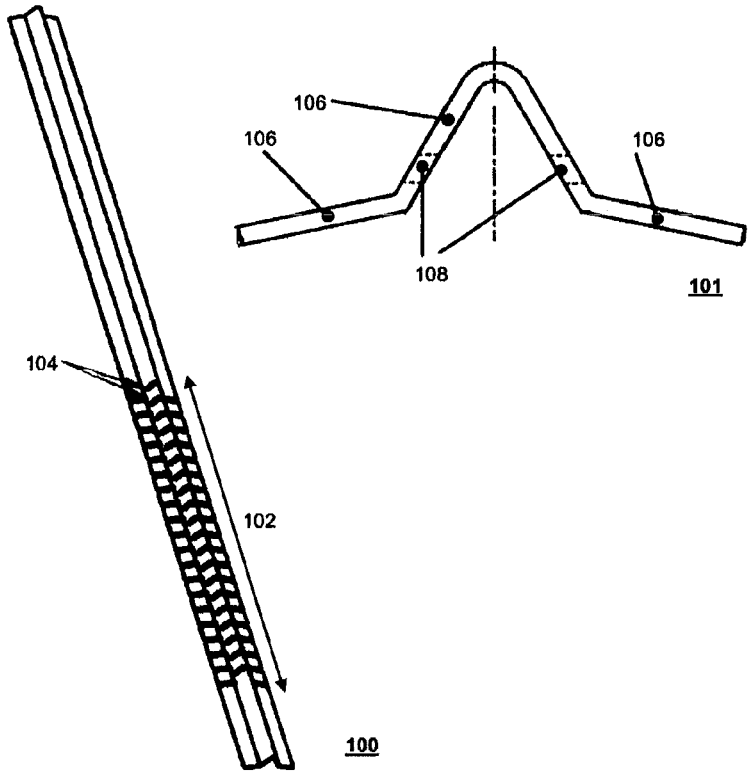
FIG. 5 shows an exemplary embodiment of a flexible strip according to the disclosure.
Figure 6:
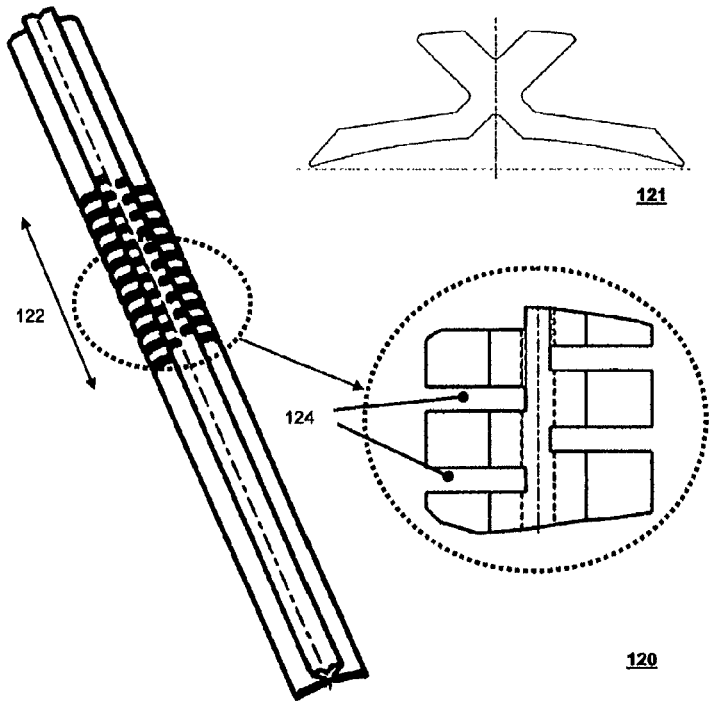
FIG. 6 shows an exemplary embodiment of a flexible strip according to the disclosure.

FIG. 5 shows an exemplary embodiment of a flexible strip with a V-shaped profile in a three-dimensional view 100 and in a cross-sectional view 101. The flexible slotted region is indicated along the arrow 102 and the slots are indicated by the reference numeral 104. In the cross-sectional illustration 101, the slotted regions 106 and the core region 108 are illustrated. Correspondingly, FIG. 6 shows an eleventh flexible strip with a X-shaped profile in a three-dimensional view 120 and in a cross-sectional view 121. The flexible slotted region is indicated along the arrow 122 and the mutually offset slots are indicated by the reference numeral 124.

Figure 7:
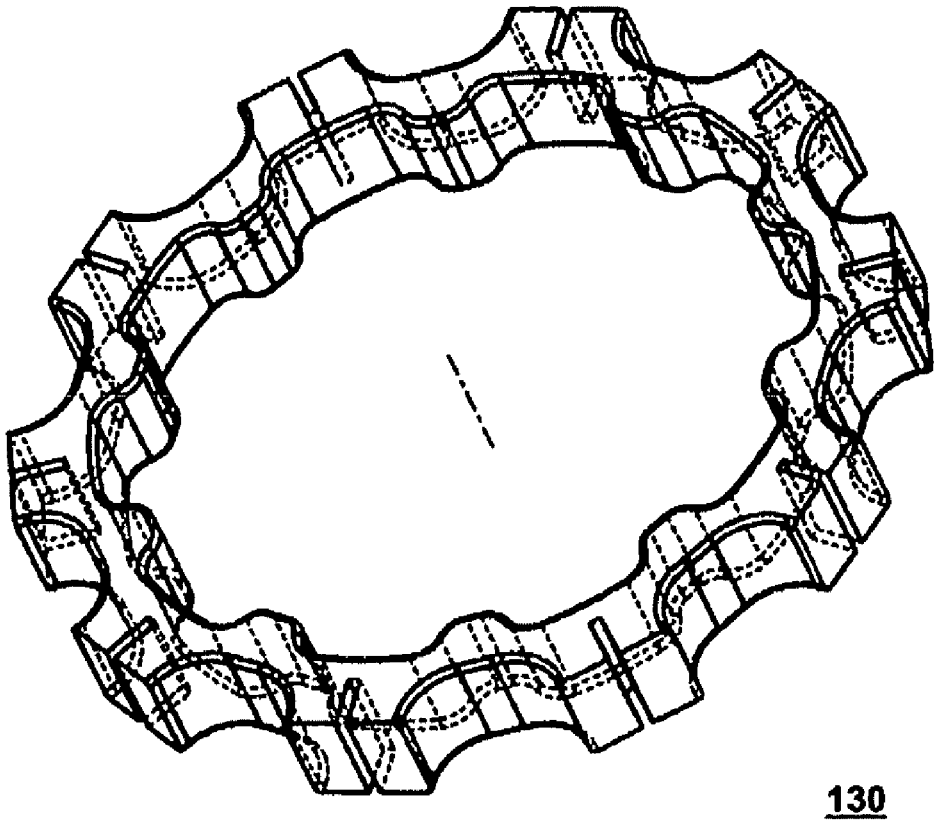
FIG. 7 shows an exemplary embodiment of a supporting ring according to the disclosure.

FIG. 7 shows the supporting ring 72 from FIG. 3 in a three-dimensional detail illustration 130.

Thus, it will be appreciated by those skilled in the art that the present invention can be embodied in other specific forms without departing from the spirit or essential characteristics thereof. The presently disclosed embodiments are therefore considered in all respects to be illustrative and not restricted.

The scope of the invention is indicated by the appended claims rather than the foregoing description and all changes that come within the meaning and range and equivalence thereof are intended to be embraced therein.

List of Reference Symbols

10 First lead-out tube in a simplified illustration
12 First shielding tube
14 Curved path
16 First insulating layer
18 First flexible strips
20 First radial distance
22 Second radial distance
24 Circular path
30 Second lead-out tube in a simplified illustration
32 Second shielding tube
34 Curved path
36 Second flexible strip
38 Third flexible strip
40 Fourth flexible strip
42 Fifth flexible strip
44 Sixth flexible strip
46 Curved region
48 Second insulating layer
49 Inner insulating layer
50 First supporting rings
60 Third lead-out tube in a simplified illustration
62 Third shielding tube
64 Basic insulating layer
66 Seventh flexible strips
68 Eighth flexible strips
70 Third insulating layer
72 Second supporting ring
74 First cutout
76 Second cutout
78 Fourth insulating layer
80 Ninth flexible strip
81 Cross-sectional profile of ninth flexible strip
82 Region of curvature of ninth flexible strip
84 Slots
86 Core cross-sectional area of ninth flexible strip
88 Slotted region of ninth flexible strip
100 Tenth flexible strip
101 Cross-sectional profile of tenth flexible strip
102 Region of curvature of tenth flexible strip
104 Slots
106 Slotted region of tenth flexible strip
108 Core cross-sectional area of tenth flexible strip
120 Eleventh flexible strip
121 Cross-sectional profile of eleventh flexible strip
122 Region of curvature of eleventh flexible strip
124 Slots
130 Third supporting ring

What is claimed is:

1. A lead-out tube for high-voltage transformers, comprising:

a shielding tube of an electrically conductive material extending hollow-cylindrically around an at least sectionally curved path in an axial direction thereof;

a hollow-cylindrical shaped electrical insulating layer arranged at a first radial distance around the shielding tube along an axial extent thereof; and a plurality of sectionally flexible strips each arranged along the at least sectionally curved path adjacent to one another at a second radial distance around the shielding tube;

wherein the insulating layer is wound from a tape-like insulating material around the plurality of sectionally flexible strips.

2. The lead-out tube as claimed in claim 1, comprising:

a plurality of radially spaced-apart insulating layers.

3. The lead-out tube as claimed in claim 1, wherein the plurality of sectionally flexible strips have an angled profile and comprise:

at least in the region of curvature, a plurality of slots arranged transversely with respect to respective axial extents thereof.

4. The lead-out tube as claimed in claim 3, wherein the angled profile of a flexible strip is in the form of an X-shaped, T-shaped, V-shaped and/or Y-shaped profile.

5. The lead-out tube as claimed in claim 1, comprising:

a basic insulating layer enveloping the shielding tube in its radially outer region.

6. The lead-out tube as claimed in claim 2, wherein the radially innermost insulating layer is spaced apart from the shielding tube or from the basic insulating layer thereof directly by the strips.

7. The lead-out tube as claimed in claim 2, comprising:

a plurality of supporting rings, wherein the strips, which are arranged at a radial distance around the shielding tube, of at least one insulating layer are connected, along their axial extent, to the plurality of supporting rings, in each case on the radially outer circumference thereof, the plurality of supporting rings each being spaced apart axially from one another, and being arranged transversely with respect to the curved path and having an inner opening.

8. The lead-out tube as claimed in claim 7, wherein at least one supporting ring surrounds a radially inner insulating layer with its inner opening with a mechanically operative connection.

9. The lead-out tube as claimed in claims 7, wherein at least one of the inner opening of the supporting ring and the radially outer circumference thereof are polygonal.

10. The lead-out tube as claimed in claim 7, wherein the cross-section of at least one supporting ring comprises:

cutouts, in addition to the inner opening.

11. The lead-out tube as claimed in claim 7, wherein the supporting ring comprises:

pressboard.

12. The lead-out tube as claimed in claim 1, wherein the tape-like insulating material comprises:

a cellulose-based material.

13. The lead-out tube as claimed in claim 1, wherein the tape-like insulating material is coated on at least one side with an adhesive layer.

14. An oil-filled transformer, comprising:

a lead-out tube for high voltage transformers including:

a shielding tube of an electrically conductive material extending hollow-cylindrically around an at least sectionally curved path in an axial direction thereof;

a hollow-cylindrical shaped electrical insulating layer arranged at a first radial distance around the shielding tube along an axial extent thereof; and a plurality of sectionally flexible strips each arranged along the at least sectionally curved path adjacent to one another at a second radial distance around the shielding tube;

wherein the insulating layer is wound from a tape-like insulating material around the plurality of sectionally flexible strips.

15. The oil-filled transformer as claimed in claim 14, comprising:

a plurality of radially spaced-apart insulating layers.

16. The oil-filled transformer as claimed in claim 14, wherein the plurality of sectionally flexible strips have an angled profile and comprise:

at least in the region of curvature, a plurality of slots arranged transversely with respect to respective axial extents thereof.

17. The oil-filled transformer as claimed in claim 14, wherein the angled profile of a flexible strip is in the form of an X-shaped, T-shaped, V-shaped and/or Y-shaped profile.

18. The oil-filled transformer as claimed in claim 14, comprising:

a basic insulating layer enveloping the shielding tube in its radially outer region.

19. A method for producing a sectionally curved lead-out tube for high-voltage transformers, the lead-out tube including a shielding tube of an electrically conductive material which extends hollow-cylindrically around an at least sectionally curved path in an axial direction thereof, a hollow-cylindrical shaped electrical insulating layer arranged at a first radial distance around the shielding tube along the axial direction thereof, sectionally flexible strips which are each arranged along the at least sectionally curved path adjacent to one another at a second radial distance around the shielding tube, wherein the insulating layer is wound from a tape-like insulating material around the sectionally flexible strips, the method comprising:

arranging the sectionally flexible strips on a circular path around the electrical insulating layer of the shielding tube, in each case along the axial direction thereof at the second radial distance therefrom;

bending the sectionally flexible strips corresponding to a curvature of the shielding tube;

fixing the sectionally flexible strips;

winding the tape-like insulating material around an arrangement of the sectionally flexible strips to form a first insulating layer to surround and be spaced apart from the shielding tube;

placing a plurality of supporting rings over the hollow-cylindrical insulating layer;

axially spacing-apart and fixing the supporting rings;

arranging the plurality of sectionally flexible strips on a circular path around an outer radii of the supporting rings in each case along the axial direction of the sectionally curved shielding tube;

bending the sectionally flexible strips corresponding to a bend of the shielding tube;

fixing the sectionally flexible strips; and winding the tape-like insulating material around the sectionally flexible strip arrangement to form a second insulating layer to surround and be spaced apart from the first insulating layer.

* * * * *